US008769882B2

(12) United States Patent
Ebaugh et al.

(10) Patent No.: US 8,769,882 B2
(45) Date of Patent: Jul. 8, 2014

(54) PROTECTION SYSTEM FOR STRUCTURAL MEMBERS SUCH AS CABLES

(75) Inventors: Irvin Ebaugh, Ocean City, MD (US); Timothy Keller, Salisbury, MD (US); Iravis Speicher, Salisbury, MD (US)

(73) Assignee: Hardwire, LLC, Pocomoke City, MD (US)

( * ) Notice: Subject to any disclaimer, the term of this patent is extended or adjusted under 35 U.S.C. 154(b) by 95 days.

(21) Appl. No.: 13/154,930

(22) Filed: Jun. 7, 2011

(65) Prior Publication Data

US 2011/0302856 A1 Dec. 15, 2011

Related U.S. Application Data

(60) Provisional application No. 61/397,105, filed on Jun. 7, 2010.

(51) Int. Cl.

| | |
|---|---|
| ***E04B 1/92*** | (2006.01) |
| ***E04C 3/00*** | (2006.01) |
| ***E01D 11/00*** | (2006.01) |
| *E04H 9/00* | (2006.01) |
| *E01D 19/00* | (2006.01) |

(52) U.S. Cl.

CPC . *E01D 11/00* (2013.01); *E04H 9/00* (2013.01); *E01D 19/00* (2013.01)

USPC ..... 52/3; 52/173.1; 52/835

(58) Field of Classification Search

CPC ..... E01D 19/10; E04B 1/92; E04B 1/94; E04B 1/945; E04B 1/948; E04B 1/98

USPC ..... 52/1, 3, 167.1, 173.1, 835; 14/22; 285/373; 174/92, 481, 503, 504, 507

See application file for complete search history.

(56) References Cited

U.S. PATENT DOCUMENTS

| | | | | |
|---|---|---|---|---|
| 1,060,328 | A * | 4/1913 | Farley | 126/314 |
| 4,601,334 | A * | 7/1986 | Lovegrove | 166/241.7 |
| 4,692,564 | A * | 9/1987 | Campbell et al. | 174/92 |
| 4,878,327 | A * | 11/1989 | Nutzel et al. | 52/223.13 |
| 4,951,442 | A * | 8/1990 | Harbeke, Jr. | 52/745.2 |
| 5,382,756 | A * | 1/1995 | Dagan | 174/92 |
| 5,399,811 | A * | 3/1995 | Fremgen et al. | 174/93 |
| 5,452,551 | A * | 9/1995 | Charland et al. | 52/232 |
| 6,242,700 | B1 * | 6/2001 | Smith | 174/77 R |
| 6,466,725 | B2 * | 10/2002 | Battey et al. | 385/135 |
| 6,725,615 | B1 * | 4/2004 | Porter | 52/1 |
| 7,748,307 | B2 | 7/2010 | Hallissy et al. | |
| 2012/0006209 | A1 * | 1/2012 | Mathey et al. | 100/92 |
| 2012/0058338 | A1 * | 3/2012 | Fyfe et al. | 428/365 |

FOREIGN PATENT DOCUMENTS

| | | | |
|---|---|---|---|
| DE | 202012002553 | U1 * | 6/2012 |
| EP | 0169276 | A1 * | 1/1986 |
| EP | 497460 | A1 * | 8/1992 |
| WO | WO 2007093703 | A2 * | 8/2007 |

* cited by examiner

*Primary Examiner* — Elizabeth A Plummer

(74) *Attorney, Agent, or Firm* — McLane, Graf, Raulerson & Middleton, PA

(57) ABSTRACT

A protection system for a structural element is provided. The protection system employs a shield assembly comprising two parts formed of one or more materials configured to provide protection from a threat, such as a blast, projectiles, cutting, or a fire. At least one bracket assembly attaches to the structural element. The shield assembly is hingedly attached to the bracket assembly, so that the two parts of the shield assembly can be moved away from the structural element while remaining attached to the structural element.

12 Claims, 8 Drawing Sheets

PROTECTION SYSTEM FOR STRUCTURAL MEMBERS SUCH AS CABLES

CROSS REFERENCE TO RELATED APPLICATION

This application claims the benefit under 35 U.S.C. §119 (e) of U.S. Provisional Patent Application No. 61/397,105, filed on Jun. 7, 2010, the disclosure of which is incorporated by reference herein.

STATEMENT REGARDING FEDERALLY SPONSORED RESEARCH OR DEVELOPMENT

N/A

BACKGROUND OF THE INVENTION

Structural members of bridges, tunnels, buildings, and other structures often require protection from various threats to their integrity. These threats can be manmade or natural and may include blasts, including both air blast wave and fragmentation, ballistic projectiles, mechanical cutting, thermal torch cutting, and fire. In some cases, the form of protection from these threats is permanently affixed to the structural member to be protected. In other cases, the form of protection must be substantially removed to allow for inspection of the structural member underneath.

SUMMARY OF THE INVENTION

A protection system for a structural element is provided which allows the protection system to be pivoted or otherwise moved away from the structural element to allow for inspection, while remaining attached to the structural element.

In one exemplary embodiment, a protection system includes a shield assembly comprising two parts. The shield assembly is comprised of one or more materials configured to provide protection from a threat. At least one bracket assembly is provided comprising an attachment mechanism, configured for attachment to the structural element, and a hinge mechanism. The shield assembly is hingedly attached to the bracket assembly at the hinge mechanism. The two parts of the shield assembly can thereby be moved away from the structural element while remaining attached to the structural element.

DESCRIPTION OF THE DRAWINGS

The invention will be more fully understood by reference to the following detailed description when considered in conjunction with the accompanying drawings, in which.

DETAILED DESCRIPTION OF THE INVENTION

The disclosure of U.S. Provisional Patent Application No. 61/397,105, filed on Jun. 7, 2010, is incorporated by reference herein.

A protection system 10 is provided that wraps about a cable 12, or other structural member, and is hinged to be opened up, thereby allowing the cable underneath to be inspected. The protection system includes a shield assembly 14 and a bracket assembly 18 that attaches the shield assembly to the cable. The protection system is particularly described and shown herein in conjunction with a cable; however, it can be used with other structural members.

Figure 1:
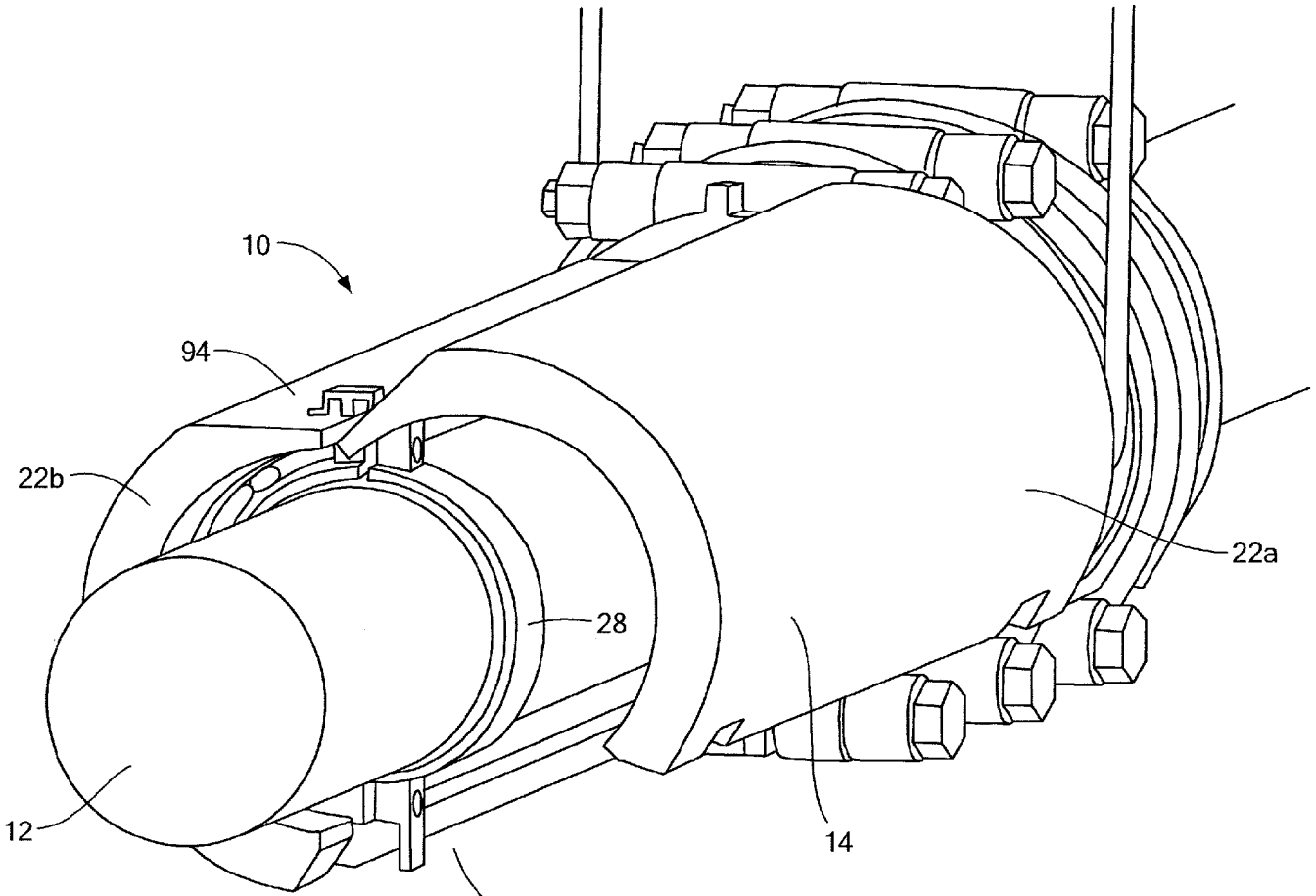
FIG. 1 is an isometric view of an embodiment of a protection system according to the present invention shown in conjunction with a cable.
Figure 3:
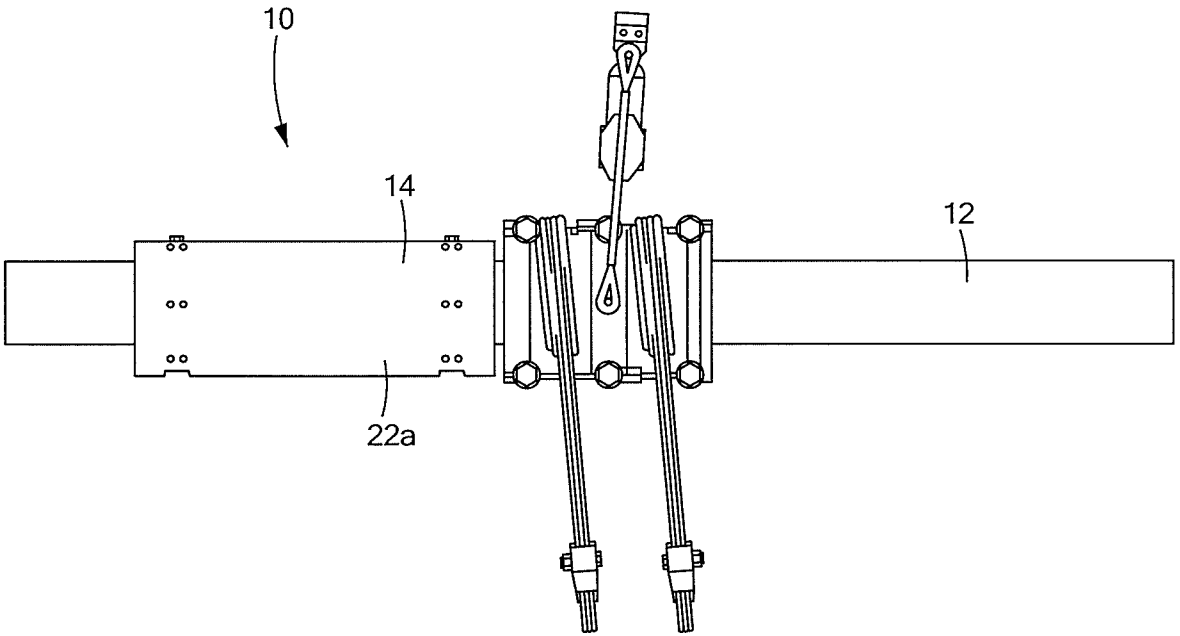
FIG. 3 is a side view of the protection system of FIG. 2.
Figure 2:
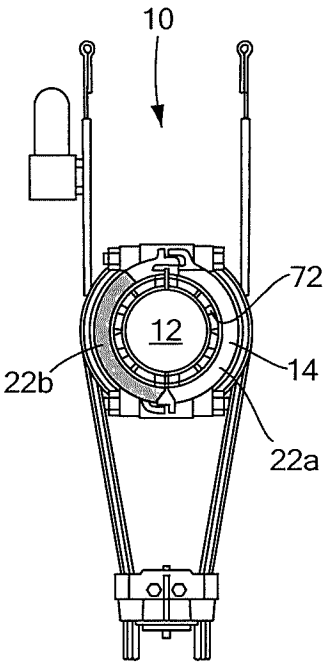
FIG. 2 is an end view of the protection system in a closed position.
Figure 5:
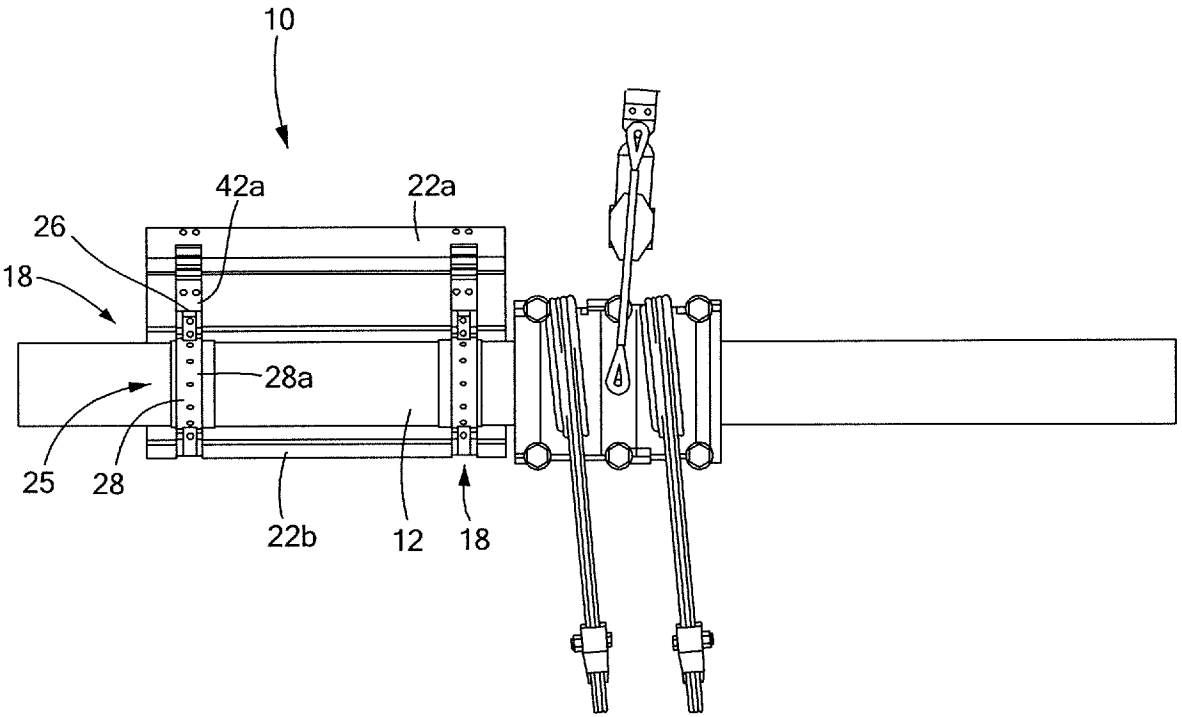
FIG. 5 is a side view of the protection system of FIG. 4.
Figure 4:
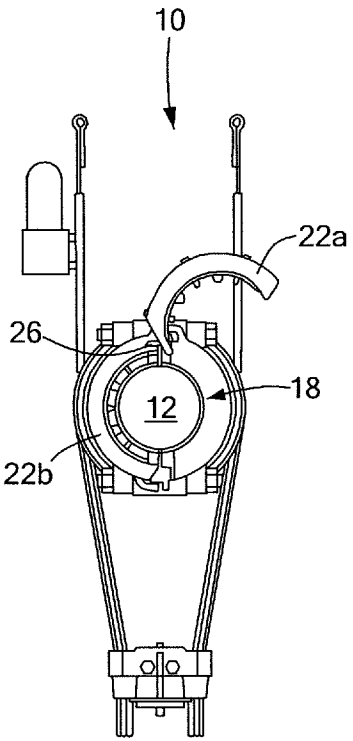
FIG. 4 is an end view of the protection system in an open position.

The shield assembly 14 is formed in a configuration to fit around the cable 12 or other structural member to be protected. In the embodiment shown in FIGS. 1-9, the shield assembly 14 is formed in two parts 22*a*, 22*b*. In a closed position, both parts enclose the cable, as shown in FIGS. 2 and 3. In an open position, one or both of the parts are pivoted away from the cable, as shown in FIGS. 1 and 4-6.

The bracket assembly 18 attaches to both the underlying cable 12 and to the shield assembly 14. The bracket assembly includes an attachment mechanism 25 that attaches to the underlying cable, and a hinge mechanism 26 that provides the ability to pivot the two parts 22*a*, 22*b* away from the cable 12 underneath, thereby allowing the cable to be inspected while the shield assembly remains attached to the cable via the attachment mechanism. Generally two bracket assemblies 18 are used to attach the shield assembly to a cable, one near each end of the shield assembly.

In the embodiment illustrated, the attachment mechanism 25 of each bracket assembly 18 includes a band device 28 that is fastened about the circumference of the cable. The band device is formed in two parts 28*a*, 28*b* that are suitably tightened about the cable 12 with two clamp mechanisms 32, 34. For example, each clamp mechanism includes a pair of adjacently disposed blocks 32*a*, 32*b*; 34*a*, 34*b*. A fastening member, such as bolt or screw (not shown), passes through aligned openings 36, 38 in the blocks to pull the blocks together, as would be understood by one of skill in the art. The band device can also be formed in any configuration to fit the cable, which may have an irregular or asymmetrical configuration, or to fit another structural member.

Referring more particularly to the embodiment of FIGS. 6-9, the hinge mechanism 26 of each bracket assembly 18 includes a band device 42 formed in two parts 42*a*, 42*b* that is attached to an inner surface 44 of each part of the shield assembly 14, for example with fasteners that extend through the thickness of the shield assembly. One end of each band part terminates with a hinge element 47, such as a hinge pin 48 that fits into a socket 52*a*, 52*b* in a corresponding block 32*a*, 32*b* of the clamp mechanism 32. The hinge pin can be held in the socket with, for example, a cover 54*a*, 54*b*.

A removable closure mechanism 62 is provided, for example, at the other end of the band device 42, to hold the shield assembly in a closed position. For example, in the embodiment shown, the other end of each band part 42*a*, 42*b* terminates with a flange 64*a*, 64*b* having an aperture therethrough. A corresponding aperture 66 is formed in the block 34*a*, 34*b* of the other clamp mechanism 34. A fastening element 68, such as a screw or bolt through the apertures, fastens the shield assembly to the cable in the closed position. To open the shield assembly, the fastening element is removed, and the part of the shield assembly is pivoted about the hinge pin into an open position.

The protection system can be provided in sections, each section having any suitable length, arranged serially along the length of the cable. In this manner, any length of cable can be protected. Bumpers 72 for vibration damping can be provided on the band on the shield assembly or on the band attached to the cable.

The shield assembly can incorporate a variety of materials to address the particular threats of concern to a particular cable. For example, the shield assembly can include materials that are resistant to fires, such as hydrocarbon pool and jet fires, abrasive cutting saws, thermal cutting torches, ballistic threats, and blast threats. The materials for the various types of protection are known in the art and can be layered as desired to form the shield assembly. Also, the material for a particular threat can be strategically located where the threat is greatest. For example, blast and ballistic protection can be disposed facing a roadway and need not be wrapped about the entire circumference of the cable, as indicated by the darker shading in FIG. 2.

Typically, the materials are arranged in a layered configuration, and are disposed within a skin or shell, which can be formed of a composite or metallic material. For example, within the shell, a hard strike face is provided as an outer layer. The strike face can be formed from a naturally occurring material, such as granite; a ceramic material; or a metallic material, such as steel, aluminum, or titanium. Inwardly of the hard strike face, additional layer(s) can be provided. For example, the layers can include laminates of high strength steel fabrics incorporating thin twisted steel cords, such as that available from HARDWIRE LLC in Maryland. Other materials can include composites such as laminates of ultra high molecular weight polyethylene fibers in a urethane or other resin matrix. Other fibers, such as, aramid, fiberglass, carbon, or KEVLAR® fibers, can be used. Other configurations of materials and types of materials can be used as well.

Figure 10:
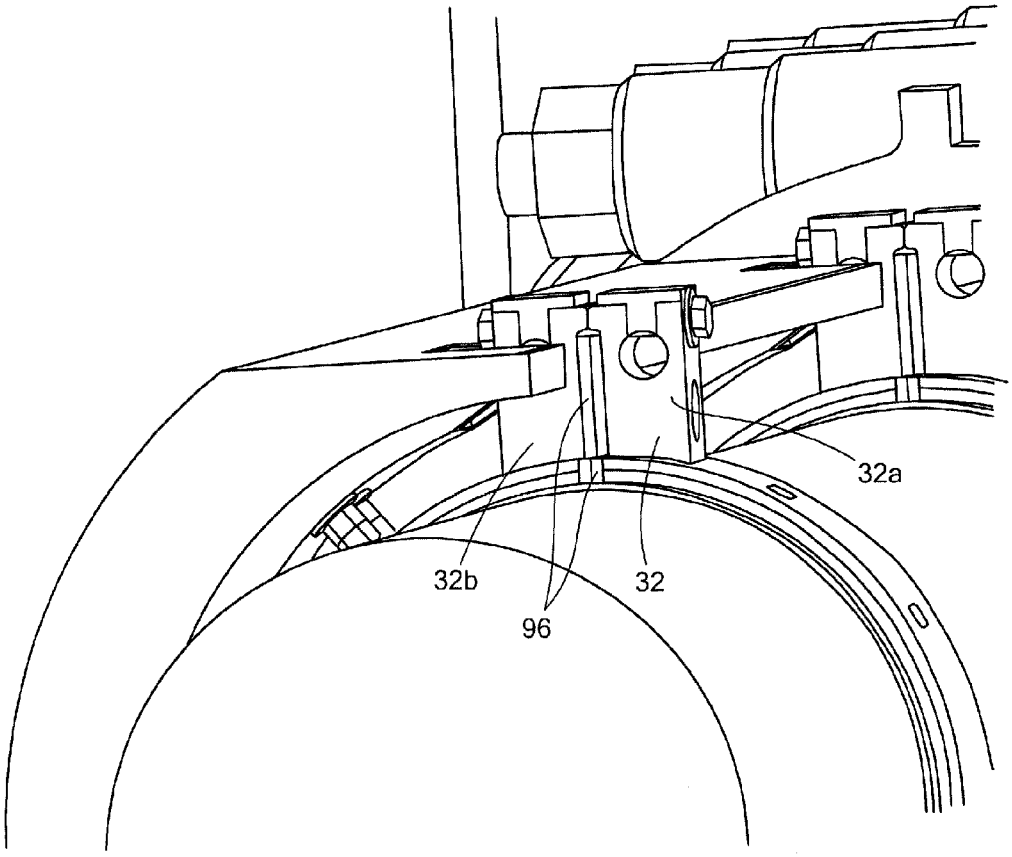
FIG. 10 is a partial isometric view of the bracket assembly illustrating a sealing material within a clamp mechanism.

The protection system can be sealed against environmental infiltration. For example, a sealing material 92 can be disposed beneath the band that clamps about the cable, and a sealing material 96 can be disposed within a clamp mechanism (see FIG. 10). The protection system can also integrate with existing cable de-humidification elements, for example, an airtight wrapping that is applied over the cable. The shield assembly can incorporate ultraviolet protection in an outer layer or layers, such as in the shell. Similarly the shield assembly can incorporate a corrosion resistant outer surface.

Figure 6:
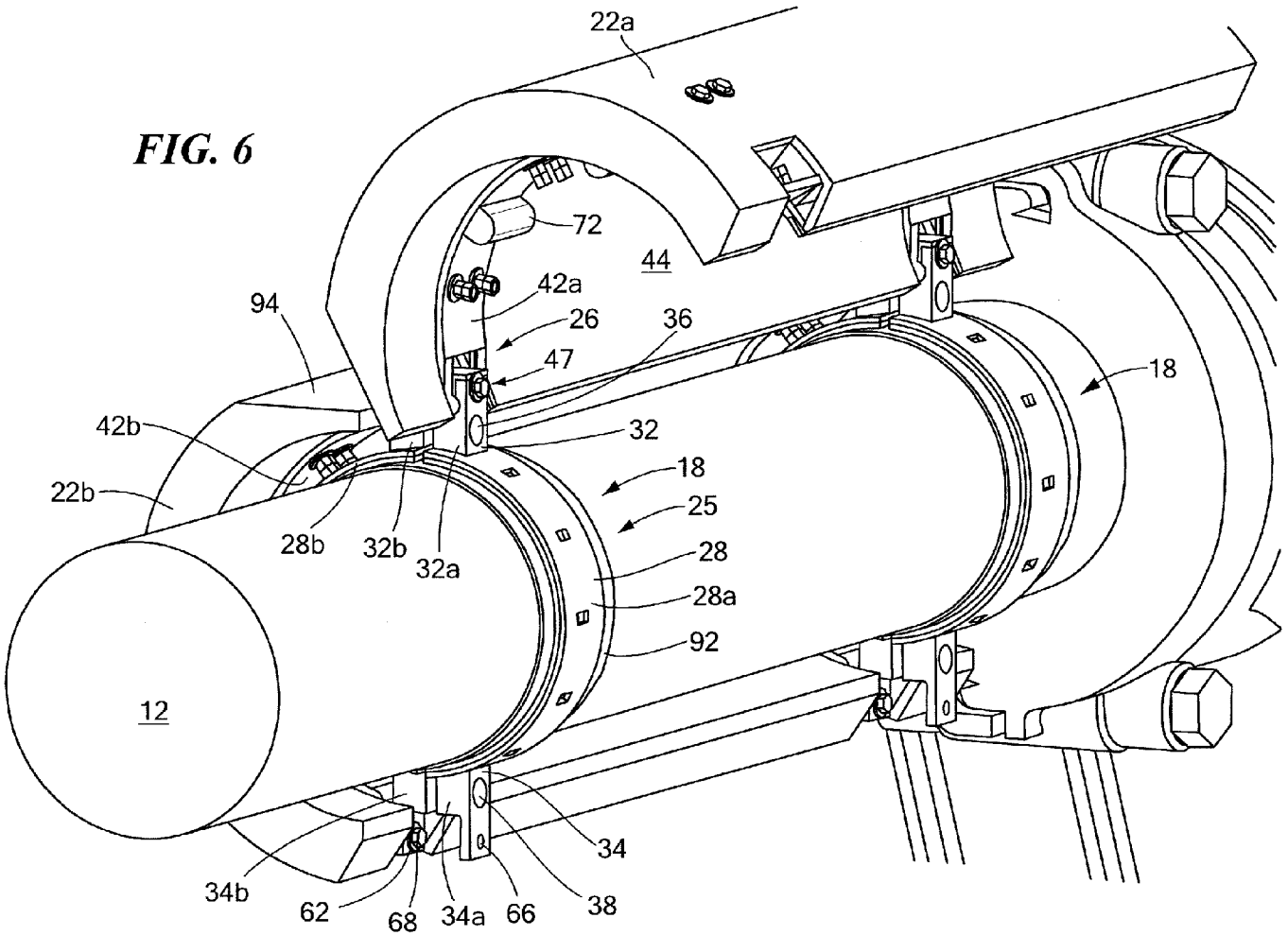
FIG. 6 is an isometric view of the protection system in an open position.
Figure 7:
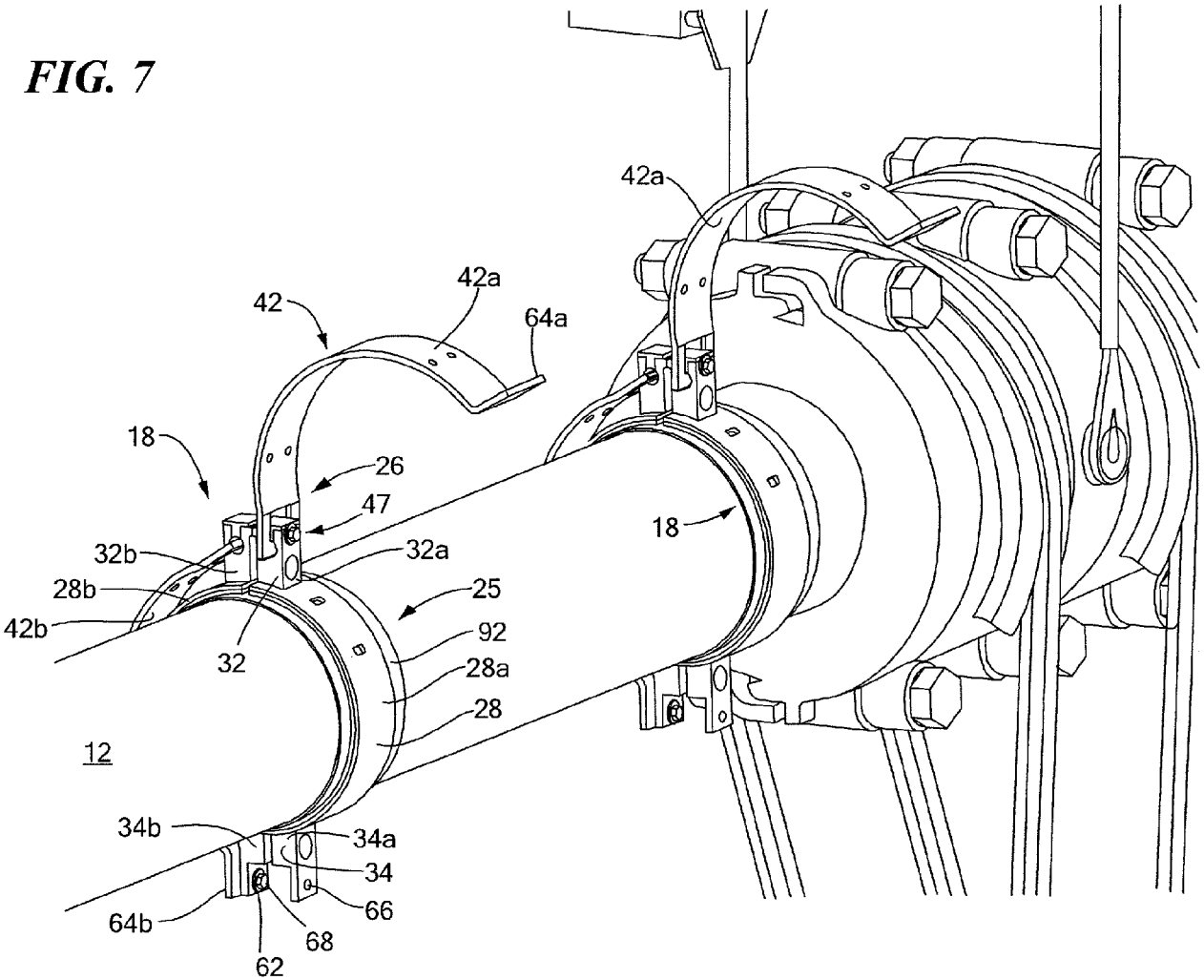
FIG. 7 is an isometric view of the protection system in an open position with the shield assembly removed for clarity.
Figure 8:
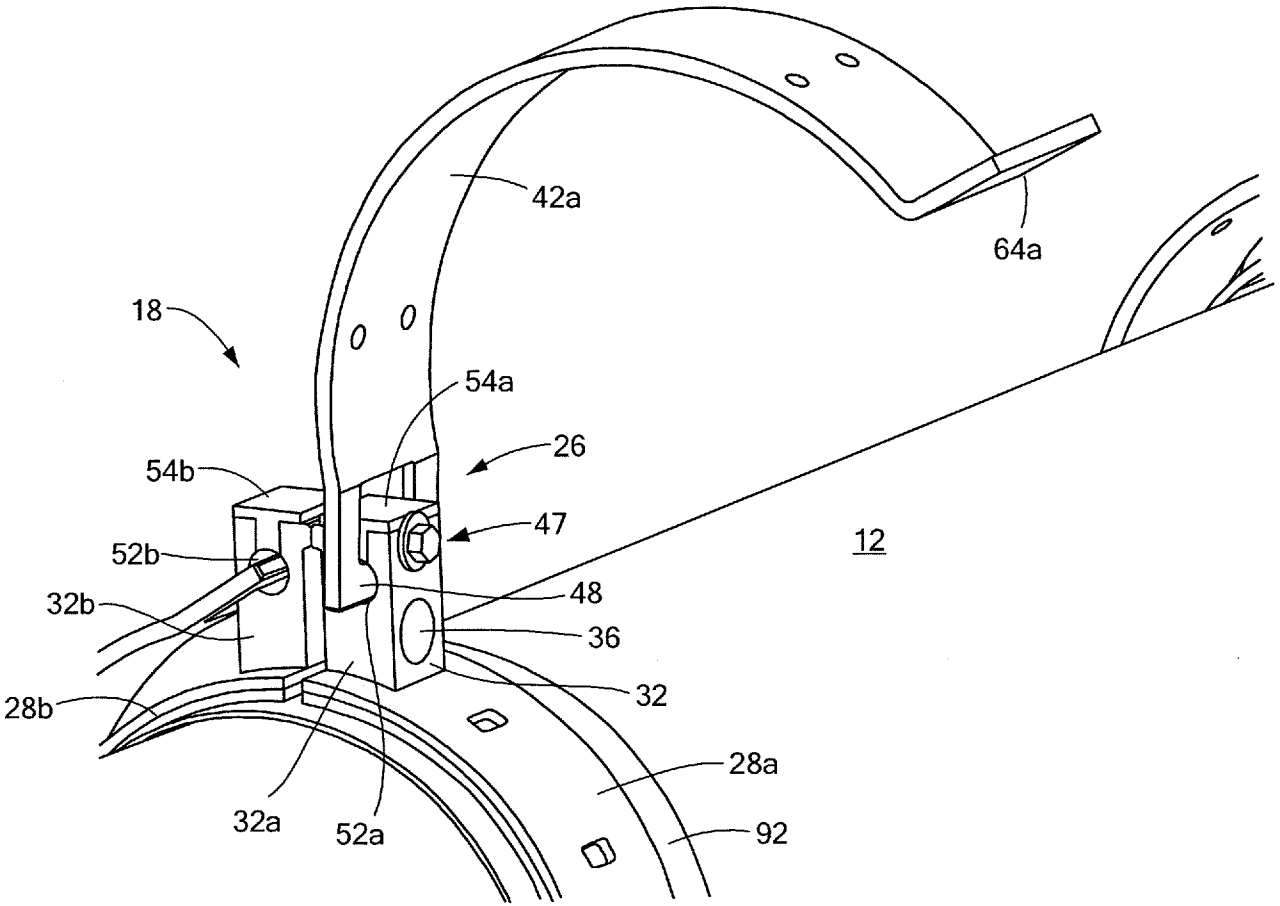
FIG. 8 is a partial isometric view of an embodiment of the bracket assembly of the protection system.
Figure 9:
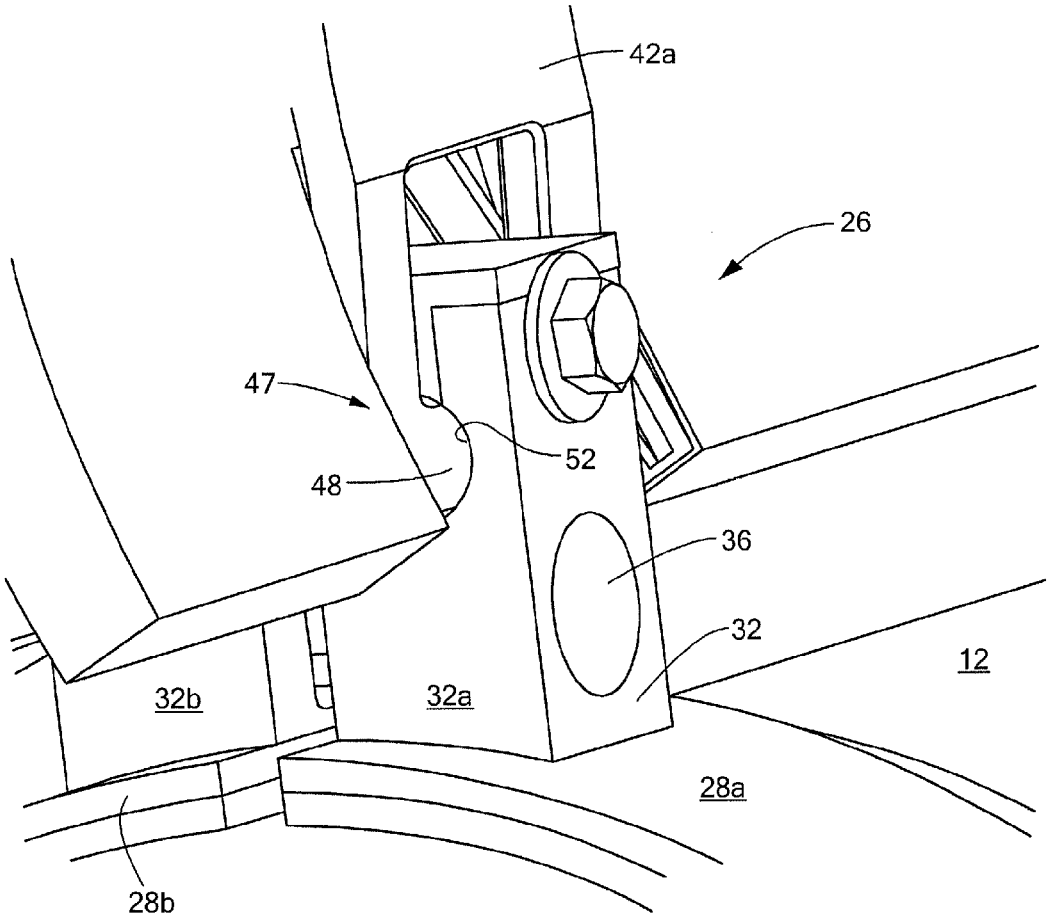
FIG. 9 is a partial isometric view of the bracket assembly particularly illustrating an embodiment of a hinge mechanism.

The shield assembly can be formed with a flat walking surface 94, particularly for smaller diameter cables (see FIG. 6). The walking surface can be faced or coated with a non-skid material.

The protection system can be employed on cables having a wide variety of diameters and configurations. Cable diameters typically range from, for example, 1 inch to 50 inches. Greater or lesser diameter cables can also be protected with the present system. In some cases, the cable may have an asymmetric or irregular configuration, and the parts of the shield assembly can be fabricated to accommodate that configuration.

The protection system can be used on a variety of types of cables, such as the main cables and the suspender cables of a suspension bridge and the stay cables of a cable-stayed bridge. The protection system obviates the need for removing the protection system to inspect the cable underneath, a process that typically requires the use of a crane and may require closing the roadway to traffic.

It will be appreciated that the protection system, while described in conjunction with a cable, can be adapted for structural members having other configurations and for other applications. The embodiments and applications of the protection system presented above are illustrative. Other configurations and embodiments are possible; for example, the clamp mechanism can be integrated into the shield assembly. The invention is not to be limited by what has been particularly shown and described, except as indicated by the appended claims.

What is claimed is:

1. A protection system for a structural element comprising a cable for a bridge, the protection system comprising:

a shield assembly comprising two parts, the shield assembly comprised of one or more materials configured to provide protection from a threat;

at least one bracket assembly comprising:

an attachment mechanism configured for attachment to the cable of the structural element, the attachment mechanism comprising a band device configured to wrap about a periphery of the structural element, and a hinge mechanism comprising a further band device comprising two band parts each attached to an inner surface of each of the two parts of the shield assembly, each band part including a hinge element, each hinge element hingedly attached to the band device wrapped about the periphery of the structural element, wherein the two parts of the shield assembly can be pivoted away from the structural element while remaining attached to the structural element via the band device wrapped about the periphery of the structural element.

2. The system of claim 1, wherein the attachment mechanism further comprises a clamp mechanism configured to tighten the band device about the structural element.

3. The system of claim 1, further comprising a closure mechanism configured to hold the two parts of the shield assembly in a closed position about the structural element.

4. The system of claim 1, wherein the bracket assembly is configured for attachment to a structural element having an asymmetrical or irregular cross-section.

5. The system of claim 1, wherein the shield assembly further includes a walking surface formed thereon.

6. The system of claim 1, wherein the shield assembly is configured for attachment to a structural element having an asymmetrical or irregular cross-section.

7. The system of claim 1, wherein the two parts of the shield assembly comprise a first part and a second part, the first part and the second part each elongated in an axial direction and comprising an outer surface and an inner surface, the first part and the second part configured to enclose a periphery of the structural element with the axial direction of elongation in alignment with an axis of the structural element.

8. The system of claim 1, wherein the two parts are comprised of an outer strike face and inner composite material laminates.

9. The system of claim 1, wherein the shield assembly includes material configured to protect against blasts, ballistic projectiles, mechanical cutting, torch cutting, fire, vandalism threats, and terrorist threats.

10. The system of claim 9, wherein the material is discretely disposed within a portion of the shield assembly.

11. The system of claim 9, wherein the material is disposed to circumferentially surround the structural element.

12. A protected structural system comprising:

a structural element; and the protection system of claim 1, wherein the bracket assembly is attached to the structural element.

* * * * *